United States Patent [19]

Hewitt

[11] Patent Number: 4,813,566

[45] Date of Patent: Mar. 21, 1989

[54] MORTUARY RECORD CONTAINER AND METHOD OF ASSEMBLY

[76] Inventor: Frederick A. Hewitt, 535 Pontiac Rd., Apt. 3, Oxford, Mich. 48051

[21] Appl. No.: 138,209

[22] Filed: Dec. 28, 1987

[51] Int. Cl.[4] ..... B65D 6/02

[52] U.S. Cl. ..... 220/4 B; 220/4 E; 220/23.83

[58] Field of Search ..... 220/4 B, 4 A, 4 E, 23.4, 220/23, 23.83

[56] References Cited

U.S. PATENT DOCUMENTS

| | | | |
|---|---|---|---|
| 1,070,516 | 8/1913 | O'Brien | 220/4 B X |
| 3,485,416 | 12/1969 | Fohrman | 220/4 E |
| 3,939,967 | 2/1976 | Tenny et al. | 220/4 B X |
| 4,393,974 | 7/1983 | Levesque | 220/4 B X |
| 4,744,461 | 5/1988 | Lapham | 220/4 B X |
| 4,756,424 | 7/1988 | Schwartz | 220/4 E X |

*Primary Examiner*—Steven M. Pollard

*Attorney, Agent, or Firm*—Learman & McCulloch

[57] ABSTRACT

A mortuary record container and method of assembly wherein an imperforate sealed capsule is formed of a pair of rigid, tubular container shells which have abutting internally threaded portions on each of their abutting side walls. An externally threaded cylindrical plug is disposed radially within and spanning these shells such that it is in threaded interengagement with the internally threaded portions of each of the shells. Sealing mechanism radially inboard of the outer cylindrical surfaces of the respective container shells seals off the interengaged threaded portions to moisture-proof the capsule.

12 Claims, 1 Drawing Sheet

MORTUARY RECORD CONTAINER AND METHOD OF ASSEMBLY

BACKGROUND OF THE INVENTION

The present invention relates to mortuary record containers of a nature to function as memorabilia capsules and be buried with the deceased for the purpose of identifying the deceased and memorializing such information as pertinent dates, progeny, and perhaps a short history of the person's life and accomplishments. Various such containers have been proposed, among them cremation urns which include a chamber for enclosing memorabilia. Exemplary of devices which have been proposed for this purpose are some of the containers disclosed in the following United States patents:

1,328,988: Eckert et al.

1,712,680: Svensson 1,785,582: Hansen 4,324,026: Craft

Some of the containers which are disclosed in these patents are unsuited to my purpose which is to design a durable capsule which is constructed of contemporary materials and so designed as to be buried with the deceased to function as a virtually "forever" personal identification.

SUMMARY OF THE INVENTION

One of the prime objects of the invention is to design an air and moisture-tight capsule which can be constructed of inexpensive materials, and yet will be impervious to deteriorating influences such that it can be enclosed within a coffin with the expectation of having a virtually eternal life.

A further object of the invention is to design a container of the character described which is readily and inexpensively fabricated, and eadily assembled in a manner to enclose and seal the memorabilia.

These objects are achieved by the capsule construction disclosed which incorporates an externally threaded cylindrical plug radially inboard of, and spanning, a pair of imperforate rigid tubular container shells which both are in sealed-off, threaded interengagement with the plug.

Other objects and advantages of the invention will become apparent from the following detailed description of several embodiments of the invention which are illustrated in the accompanying drawings.

IN THE DRAWINGS

Figure 1:
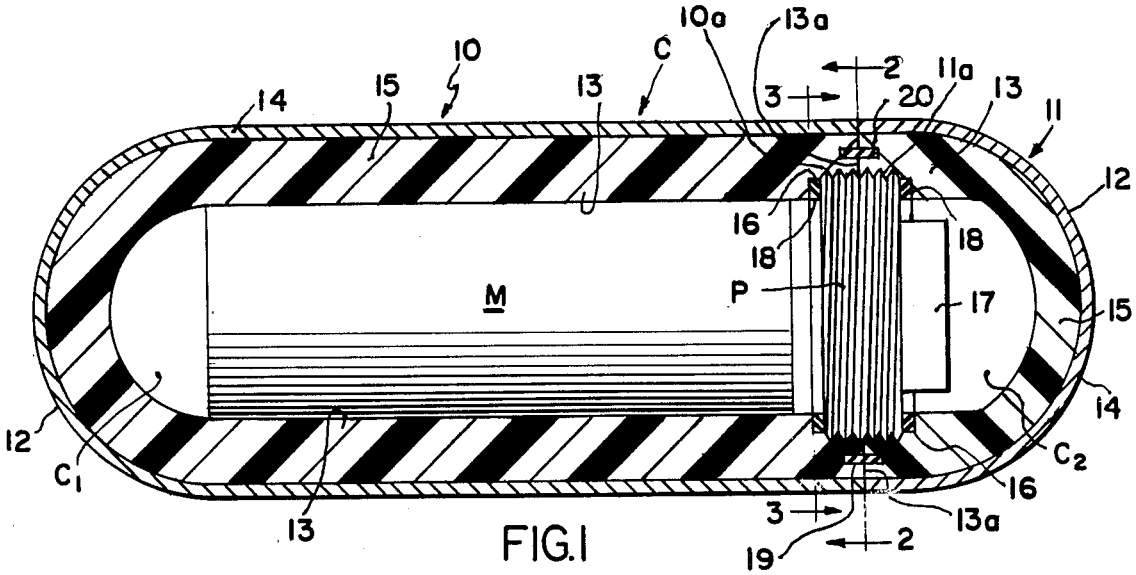
FIG. 1 is a sectional elevational view of my capsule in assembled sealed condition, with appropriate memorabilia enclosed therein.
Figure 2:
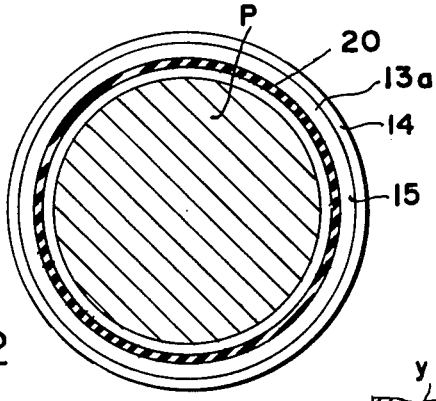
FIG. 2 is a transverse sectional view taken on the line 2—2 of FIG. 1.
Figure 3:
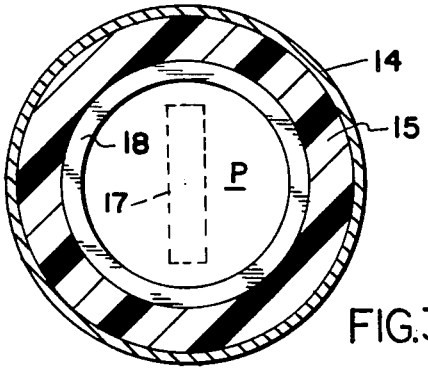
Figure 4:
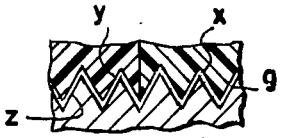
Figure 5:
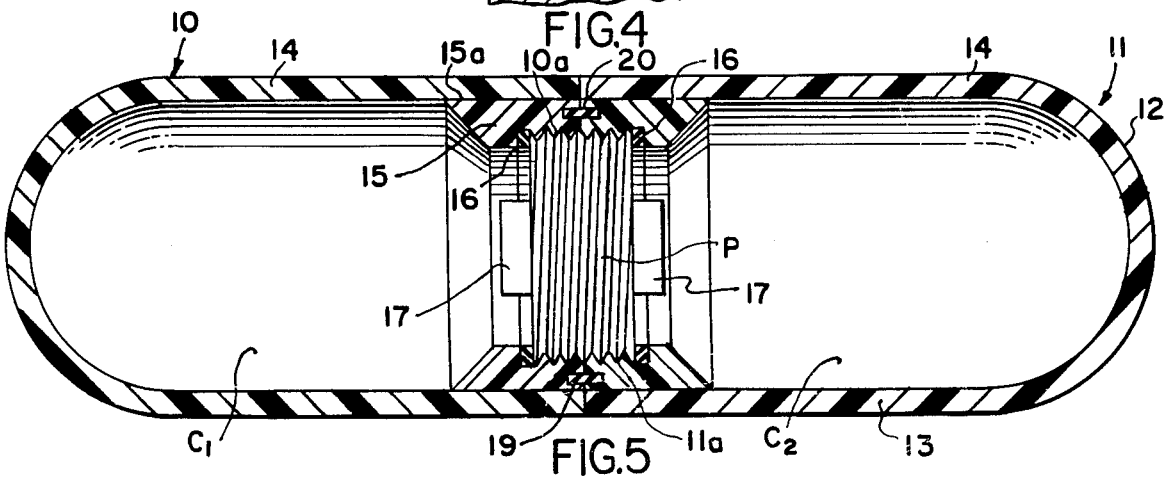

FIG. 3 is a transverse sectional view taken on the line 3—3 of FIG. 1; and FIG. 4 is a greatly enlarged, fragmentary, sectional, elevational view illustrating the manner in which a sealant gel is contained between the internal threads of the container shells and the external threads of the insert plug which sealably connects them, and FIG. 5 is a sectional elevational view of a modified embodiment of the invention.

SPECIFIC DESCRIPTION OF PREFERRED EMBODIMENTS OF THE INVENTION

Referring now more particularly to FIGS. 1–4 of the drawings initially, the capsule or container illustrated at C comprises a pair of imperforate, rigid, tubular mating container shells generally designated 10 and 11, each of which has a hemispherically closed end wall 12 and an integrated cylindrical side wall 13. As FIG. 1 indicates, the configuration is appropriate to the designated purpose and each cylindrical wall 13 includes an annular, lateral or radial wall 13*a* surrounding the open end of each shell section 10 and 11, the mating walls 13*a* having a complementary radial angularity so as to snugly abut along their full circumferential and radial surfaces. As shown in FIG. 1, each of the mating sections 10 and 11 includes an outer metal skin 14 and an inner plastic liner 15. The metal skin 14 is preferably copper, and the inner liner 15 may be formed of a synthetic plastic material which is suitably tough and rigid such as the polycarbonate resin which is marketed under the trademark LEXAN.

Each of the cylindrical said walls of the shells or sections 10 and 11 is internally threaded as at 10*a* and ll*a*, the threads x and y (FIG. 4) formed at 10*a* and 11*a* respectively being of a matching configuration with the same hand and lead. As FIG. 1 discloses, the inset threads 10*a* and ll*a*, which are radially outboard of the annular internal wall 13*b* of each of the cylindrical sections 13, extend to the walls 13*a* so that the internal threads y are a continuation of the internal threads y. Provided in the walls 13 at the end of each of the threaded portions 10*a* and 11*a*, is an annular groove 16 which is radially inset from the outer extremities of the threaded sections 10*a* and 11*a* and in alignment with the roots thereof for a purpose to be presently described. An externally threaded plug, generally designated P, having threads generally designated z (see FIG. 4) interconnects the shells 10 and While the threads z match the configuration of the threads x and y, there is, of course, a working clearance between them as shown in this greatly enlarged view. To facilitate insertion of the plug P, which separates the container C into compartments $C_l$ and $C_2$, means which can be grasped for manually rotating it is disclosed, and comprises a key 17.

Provided to seal the interior of capsule C, are compressible, long life, synthetic rubber, O-ring seals 18 snugly fitting each of the grooves 16. In addition, as shown in FIG. 4, a sealing gel g, which has a grease-like consistency, is provided in the clearance between the threads x-y, and z.

Finally, matching annular grooves 19, provided in each of the matching faces 13*a* of the shells 10 and 11, house an annular, compressible, semi-rigid resilient seal ring 20 of synthetic rubber which is of a durometer to maintain its annular configuration in an uncompressed state. Because the plug P is an imperforate rigid member, it, in effect, forms an inner end wall for the compartment $C_l$, and shell 11 forms a second rigid end wall which enhances the durability and sealability of the capsule. As FIG. 1 discloses, memorabilia M, which may take any form but in the example disclosed may be considered to be a rolled sheet of plastic-coated paper, occupies compartment $C_1$.

THE OPERATION

With the seal rings 18 already in place, the capsule C is assembled by, first of all, inserting the memorabilia M in the compartment $C_1$ and then, by manipulating key 17, threading plug P into position to a point where the seal ring 18 in container shell 10 is in a state of compression. Prior to installing the plug P in position, the sealant gel g is applied to the threads z or to the threads x-y, over their axial extent. The shell section 10 comes with the annular seal 20 already in position. As a final step, the shell section 11 is threaded on the plug P until a compression of the ring section 18 carried by the shell section 11 is achieved, and there is a snug abutment of the respective matching faces 13*a* of the shell sections 10 and 11. The matching configuration of the threads x and z assures that the groove 19 in the shell section 11 is guided into exact axial alignment to receive the semi-rigid seal 20 which, when the sections 11 and 10 tightly abut, is also in a state of axial and radial compression. Alternatively the seal 20 could be carried by the shell section 11, of course.

A FURTHER EMBODIMENT

In FIG. 5 another embodiment of the invention is disclosed in which the shell sections 10 and 11 are of the same axial length and may be formed in the same injection mold. In FIG. 5 the same numerals have been used to identify the same components for purposes of convenience, and only the several differences will be described.

In this embodiment of the invention, each of the compartments $C_1$ and $C_2$ which are partitioned by the plug P, may be used to house memorabilia M. In this embodiment of the invention, the outer wall 14 of each of the shell sections 10 and 11 may be formed of a rigid LEXAN plastic and an axially abbreviated, inner liner 15 of the same plastic is provided which may be adhesively secured as at 15*a* to the walls 14 of each of the sections 10 and 11. Except for the differences noted the construction of the capsules C in FIGS. 1–4 and 5 is identical, except that a key 17 is provided on each side of the plug P so that either of the compartments $C_1$ or $C_2$ may be initially loaded with memorabilia. Assuming that it is the compartment $C_1$ in FIG. 5 which is loaded with memorabilia before the plug P is inserted, it is to be understood that the shell section 11 may be loaded with additional memorabilia prior to the time it is threaded into position on the plug P. The assembly of the container disclosed in FIG. 5 is otherwise identical to the assembly of the container illustrated in FIGS. 1–4, and its construction and operation need not further be described.

It is to be understood that the embodiments described are exemplary of various forms of the invention only and that the invention is defined in the appended claims which contemplate various modifications within the spirit and scope of the invention.

What is claimed is:

1. A mortuary record container comprising:

a. an imperforate sealed elongate capsule comprising a pair of rigid tubular container shells, each having a closed end wall and an integrated cylindrical side wall with a lateral wall surrounding an open end, the lateral walls being of mating configuration so as to snugly abut and form a surface-to-surface joint;

b. internally threaded portions on each of the side walls adjacent said lateral walls;

c. an externally threaded cylindrical plug, radially within and spanning said shells, said plug having an actuator portion facilitating its rotation and being in threaded interengagement with both the internally threaded portions; and d. annular seal means for sealing off said interengaged threaded portions to moisture-proof said joint.

2. The container of claim 1 wherein said actuator portion comprises an axially projecting rib on at least one end of said plug, which can be grasped to turn said plug.

3. The container of claim 1 wherein said side walls are of generally the same length and said plug divides the capsule into a pair of generally equal volume compartments.

4. The container of claim 1 wherein one of said shells is an end cap, and said rib protrudes within said end cap.

5. The container of claim 1 wherein the internally threaded portions of said side walls are provided in grooved portions of said walls so as to form shoulders at the ends of the threaded portions; and said seal means comprises compressible seal rings provided at the ends of said plug to engage with said shoulders and seal said threaded portions of the side walls.

6. The container of claim 5 wherein said seal means includes annular mating grooves provided in said abutting lateral walls and an annular compressible semi-rigid seal ring having portions received in each of said grooves and wholly contained therein; said ring being of a durometer to maintain its annular configuration in an uncompressed state.

7. The container of claim 5 wherein said seal means includes a sealant composition disposed between said interengaged threaded portions of the plug and side walls.

8. The method of assembling a mortuary record container comprising a pair of imperforate, rigid, tubular container shells, each having a closed end wall, and an integrated cylindrical side wall with a lateral wall surrounding an open end, the lateral walls being of mating configuration so as to snugly abut and form a surface-to-surface joint; the shells having internally threaded portions on each of the side walls adjacent the lateral walls; the container further having an externally threaded cylindrical plug with threads mating with the internally threaded portions of both shells, and annular seal means for moisture-proofing the joint, the steps of:

a. inserting memorabilia through the open end of one of the container shells;

b. manipulating the plug to thread it into a position in which it closes the end of said one of the container shells and protrudes axially from the said end of said one of the container shells; and c. relatively rotating the container shells to cause the other container shell to move axially into threaded interengagement with the threads on the protruding portion of the plug sufficiently to bring the lateral walls of mating configuration of the respective container shells into a position of snug abutment.

9. The method of claim 8 wherein seal rings provided within each of the container shells at the axially inboard ends of their internally threaded portions are axially compressed when the shell sections are assembled.

10. The method defined in claim 8 wherein a sealing gel is applied to the threads of the plug at the time it is threaded into position in said one of the container shells and similarly is provided between the threads of the plug and the other container shell when the other container shell is threaded into position.

11. The method defined in claim 8 wherein said one container shell has an axially protruding annular seal ring and said other container shell has an annular groove to receive it, and the step of threading said other container shell into position guides said groove to receive said ring, and axially and radially compresses said seal ring.

12. The method defined in claim 1 wherein said plug has an axially protruding key, and the step of threading said plug into position in said one container shell is accomplished by manually grasping and turning said key.

* * * * *